US011712102B2

(12) United States Patent
Chen et al.

(10) Patent No.: US 11,712,102 B2
(45) Date of Patent: Aug. 1, 2023

(54) SEALED PACKAGING FOR COSMETICS

(71) Applicants: Wensheng Chen, Suzhou (CN); Andrea Perego, Castello di Brianza (IT)

(72) Inventors: Wensheng Chen, Suzhou (CN); Andrea Perego, Castello di Brianza (IT)

( * ) Notice: Subject to any disclaimer, the term of this patent is extended or adjusted under 35 U.S.C. 154(b) by 0 days.

(21) Appl. No.: 17/397,175

(22) Filed: Aug. 9, 2021

(65) Prior Publication Data

US 2021/0368967 A1 Dec. 2, 2021

Related U.S. Application Data

(63) Continuation of application No. 15/343,875, filed on Nov. 4, 2016, now Pat. No. 11,096,470.

(30) Foreign Application Priority Data

Nov. 10, 2015 (WO) ..... PCT/CN2015/094157

(51) Int. Cl.

| | |
|---|---|
| ***A45D 40/26*** | (2006.01) |
| ***A45D 40/00*** | (2006.01) |
| *A45D 40/04* | (2006.01) |

(52) U.S. Cl.

CPC ..... *A45D 40/265* (2013.01); *A45D 40/00* (2013.01); *A45D 40/04* (2013.01)

(58) Field of Classification Search

CPC ..... A45D 40/00; A45D 40/04; A45D 40/265
See application file for complete search history.

(56) References Cited

U.S. PATENT DOCUMENTS

| | | | | |
|---|---|---|---|---|
| 8,556,527 | B1 | 10/2013 | Chou | |
| 9,592,935 | B1 * | 3/2017 | Jacob | B65D 41/0407 |
| 10,966,505 | B2 | 4/2021 | Drugeon et al. | |
| 2006/0032512 | A1 | 2/2006 | Kress et al. | |
| 2015/0182005 | A1 | 7/2015 | Pires et al. | |
| 2016/0120290 | A1 | 5/2016 | Chen | |

(Continued)

FOREIGN PATENT DOCUMENTS

| | | | |
|---|---|---|---|
| CN | 204 617 383 | U | 9/2015 |
| EP | 2 491 813 | A1 | 8/2012 |
| KR | 200 475 967 | Y1 | 1/2015 |

*Primary Examiner* — J C Jacyna
(74) *Attorney, Agent, or Firm* — Vorys, Sater, Seymour and Pease LLP

(57) ABSTRACT

A sealed packaging for cosmetics, defining a longitudinal axis and normal plane perpendicular to the longitudinal axis and including a first containing body, second containing body and central body, including a base and applicator; the first containing body couplable to the second containing body, defining a closing configuration, defining packaging inner volume, and an opening configuration for the packaging, the central body constrained and partially arranged inside the first and second containing bodies when the packaging is in the closing configuration, the second containing body and first containing body including a fastener to couple the second containing body and the first containing body. The packaging including sealing device, including a seal and a supporting base arranged to be adjacent and opposite in the closing configuration to ensure airtightness of the packaging. The sealing device separate from the fastener and spaced apart along the axial direction.

16 Claims, 8 Drawing Sheets

(56) References Cited

U.S. PATENT DOCUMENTS

| | | | |
|---|---|---|---|
| 2016/0278503 | A1 | 9/2016 | Sanchez et al. |
| 2017/0088305 | A1 | 3/2017 | Jacob et al. |
| 2017/0088314 | A1 | 3/2017 | Jacob et al. |
| 2017/0202339 | A1 | 7/2017 | Gunter et al. |

* cited by examiner

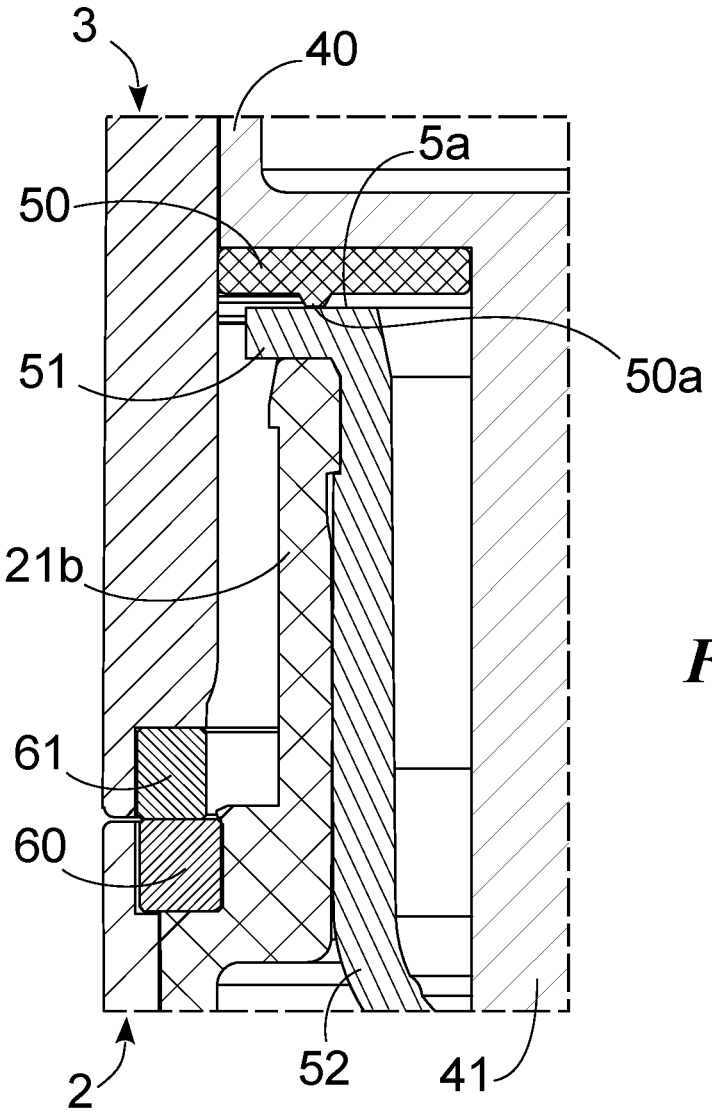
*Fig. 6*
*Fig. 7a*
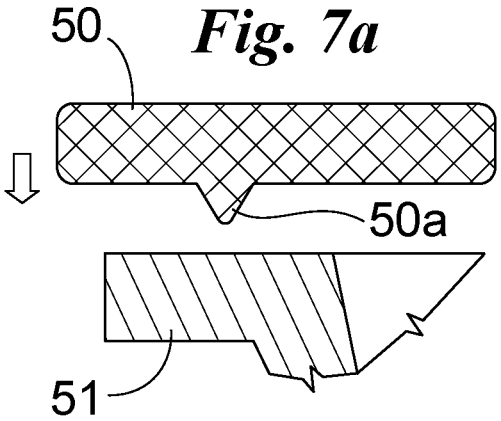
*Fig. 7b*
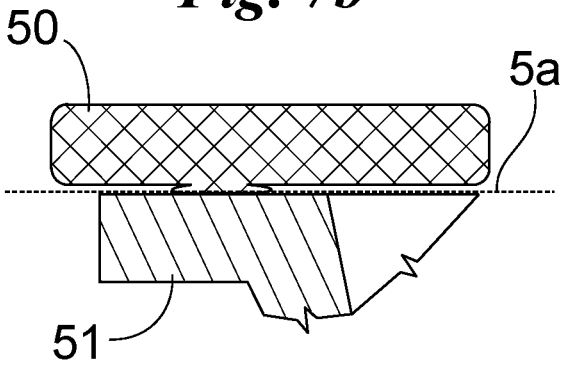

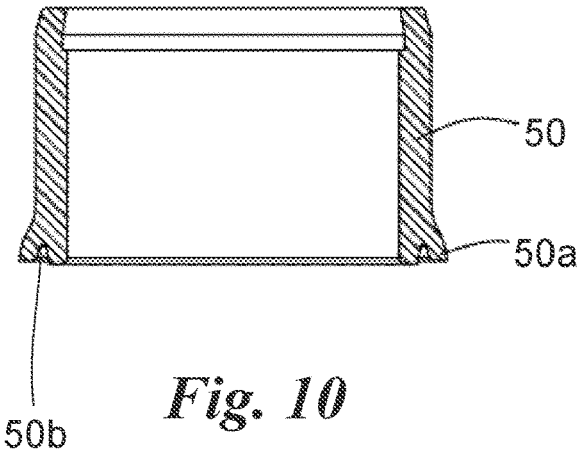
*Fig. 10*
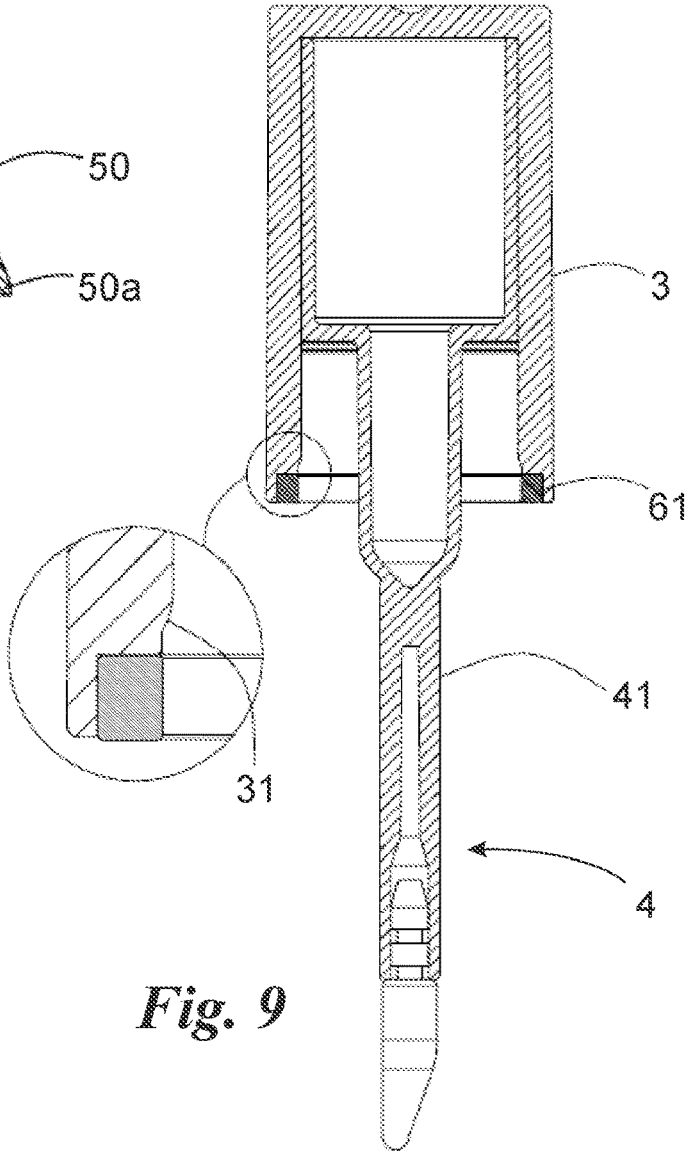
*Fig. 9*
*Fig. 13*
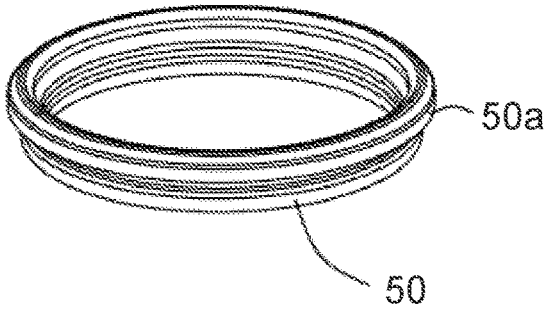

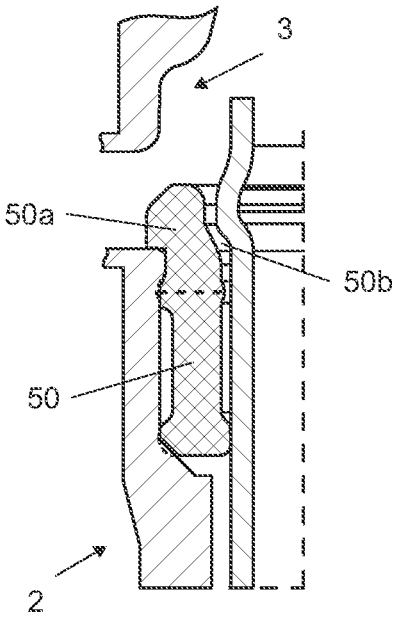
*Fig. 15a*
*Fig. 15b*
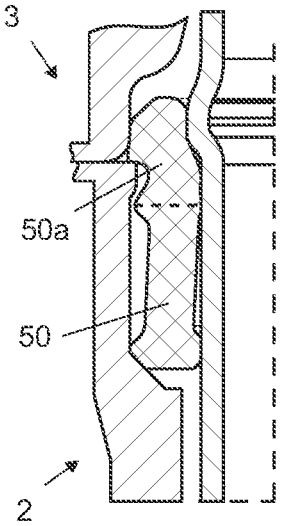
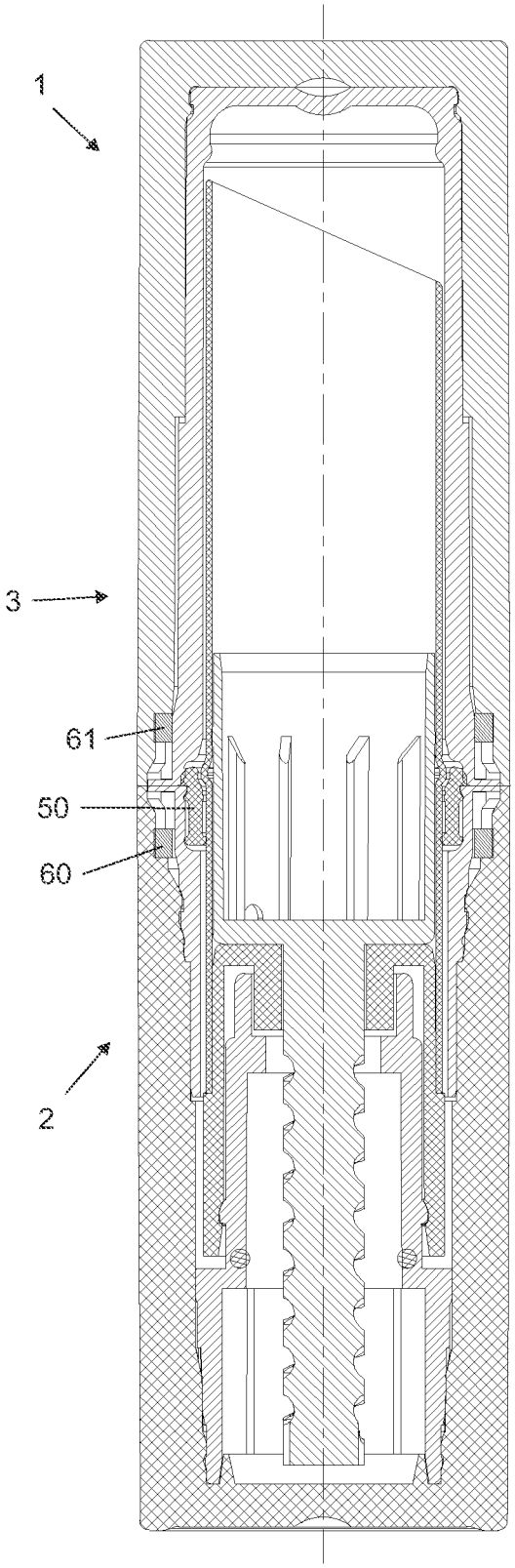
*Fig. 14*

SEALED PACKAGING FOR COSMETICS

This application is a continuation of U.S. patent application Ser. No. 15/343,875, filed Apr. 11, 2016, and claims the benefit of Patent Cooperation Treaty Application no. PCT/CN2015/094157, filed Nov. 10, 2015, each incorporated herein by reference in its entirety.

BACKGROUND OF THE INVENTION

The present invention relates to sealed packaging for cosmetics of the type specified in the preamble of the first claim.

In particular, the present invention relates to a device used for containing, and preferably applying, a cosmetic product. Such a product may be a mascara, a blusher, a lip gloss, a lipstick, an eyeliner, a kajal, an eyeshadow, a gloss, a foundation, a corrector, a serum, a cream, a skincare product, an eye cream or a skincare product.

As known, the packaging used for cosmetic products in liquid or cream state consists of a vessel housing the product and a cap which can be engaged by means of a pressure closure with the vessel in closed configuration.

In particular, the cosmetic products in cream/liquid state have a vessel consisting of a base body, on which the cosmetic product is arranged, and a casing, defining a containing chamber for the base body and the cosmetic product. Moreover, the casings commonly known may comprise kinematic means for extracting and using the cosmetic product or may be have applicators, for example.

The described prior art comprises some major drawbacks.

In particular, mainly with reference to liquid or creamy type cosmetics, the casings known from the prior art have some drawbacks from the closing point of view.

Indeed, the known packaging cannot ensure a tight closing of the containing chamber and therefore do not allow to prevent the deterioration, e.g. due to oxidation or drying, of the product contained therein.

Moreover, the non-tightness of the containers commonly used for cosmetics is worsened with use because the opening and closing of the containing casing results in local plastic deformations which, however small, lead to the wear of components and thus to an increasingly greater reduction of the sealing of the product.

As a result of the foregoing, said further drawback is that a poorly preserved cosmetic product is often thrown away before it is finished, thus determining an increase in costs and waste.

Finally, another drawback is that the containers commonly known from the prior art, in order to obviate the tightness problem, comprise closing means which are complex or require considerable releasing efforts which are not always convenient for users.

An example of closure consisting of threaded members forces the user to employ more time to open the packaging compared to the common interference models and also causes the user to apply a torque action to the closure which may lead to strain the bottom course of the thread itself resulting in loss of airtightness or damage of the closure.

On the other hand, the interference closing models may require greater efforts to be opened due to the need to overcome the obstacle provided by the interference itself.

BRIEF SUMMARY OF THE INVENTION

In this situation, the technical task underlying the present invention is to devise a sealed packaging for cosmetics capable of substantially overcome the cited drawbacks.

In the scope of said technical task, it is an important object of the invention to obtain a packaging capable of optimally preserving a cosmetic product while ensuring ease of use for a longer period of time.

It is another important object of the present invention to provide a container for cosmetics which allows to use the product contained therein entirely.

In conclusion, it is another important task of the invention to provide a sealed packaging for cosmetics which is simple and fast to be opened and which requires low forces to access the cosmetic product contained therein.

The technical tasks and the specific objects are achieved by the sealed packaging for cosmetics claimed in appended claim 1. Preferred embodiments are described in the dependent claims.

BRIEF DESCRIPTION OF THE DRAWINGS

The features and advantages of the invention will be explained in the following detailed description of preferred embodiments of the invention, with reference to the accompanying drawings, in which:

FIG. 6 shows the enlarged detail of the sealing means;

FIG. 7*a* is the protuberance in detail in open configuration;

FIG. 7*b* shows the protuberance in detail in closing position;

FIG. 9 is a structural diagram of a sealed packaging for cosmetics when a central body and a containing body are matched when the packaging is in use according to a second embodiment of the invention;

FIG. 10 is a sectional structural diagram of a sealing ring of a sealed packaging for cosmetics according to a second embodiment of the invention;

FIG. 13 is a 3D detail of the sealed packaging for cosmetics according to the third embodiment of the invention;

FIG. 14 is a sectional structural diagram of a sealed packaging for cosmetics according to a fourth embodiment of the invention;

FIG. 15*a* is a sectional structural of a detail of a sealed packaging in an opened configuration; and FIG. 15*b* is a sectional structural of a detail of a sealed packaging in an closed configuration.

DETAILED DESCRIPTION OF THE INVENTION

Figure 1:
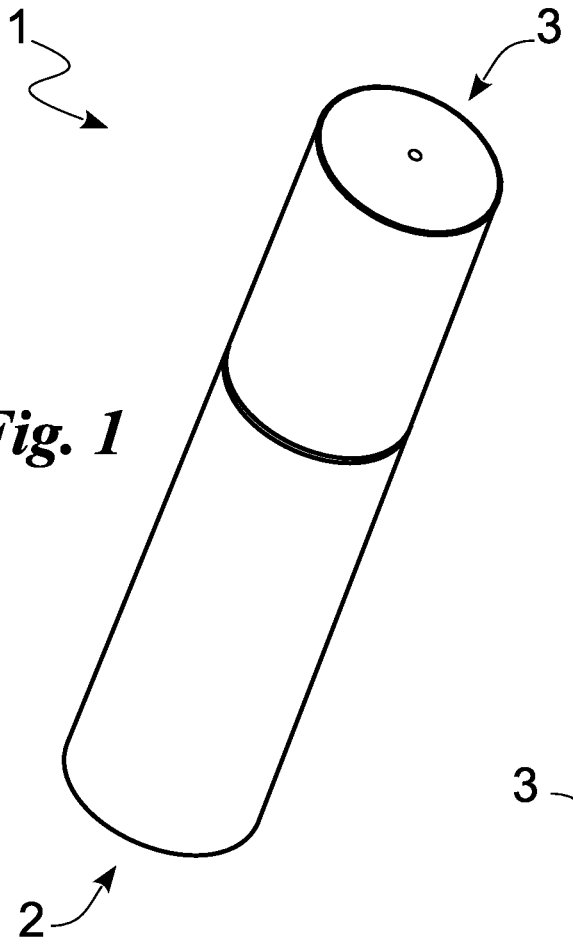
FIG. 1 shows the sealed packaging.
Figure 2:
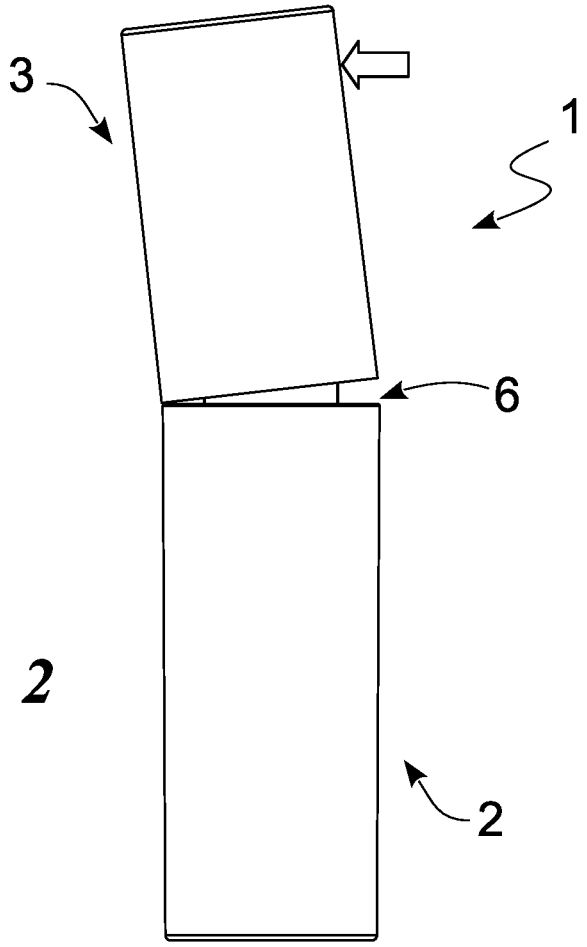
FIG. 2 shows the method of opening the sealed packaging.
Figure 3:
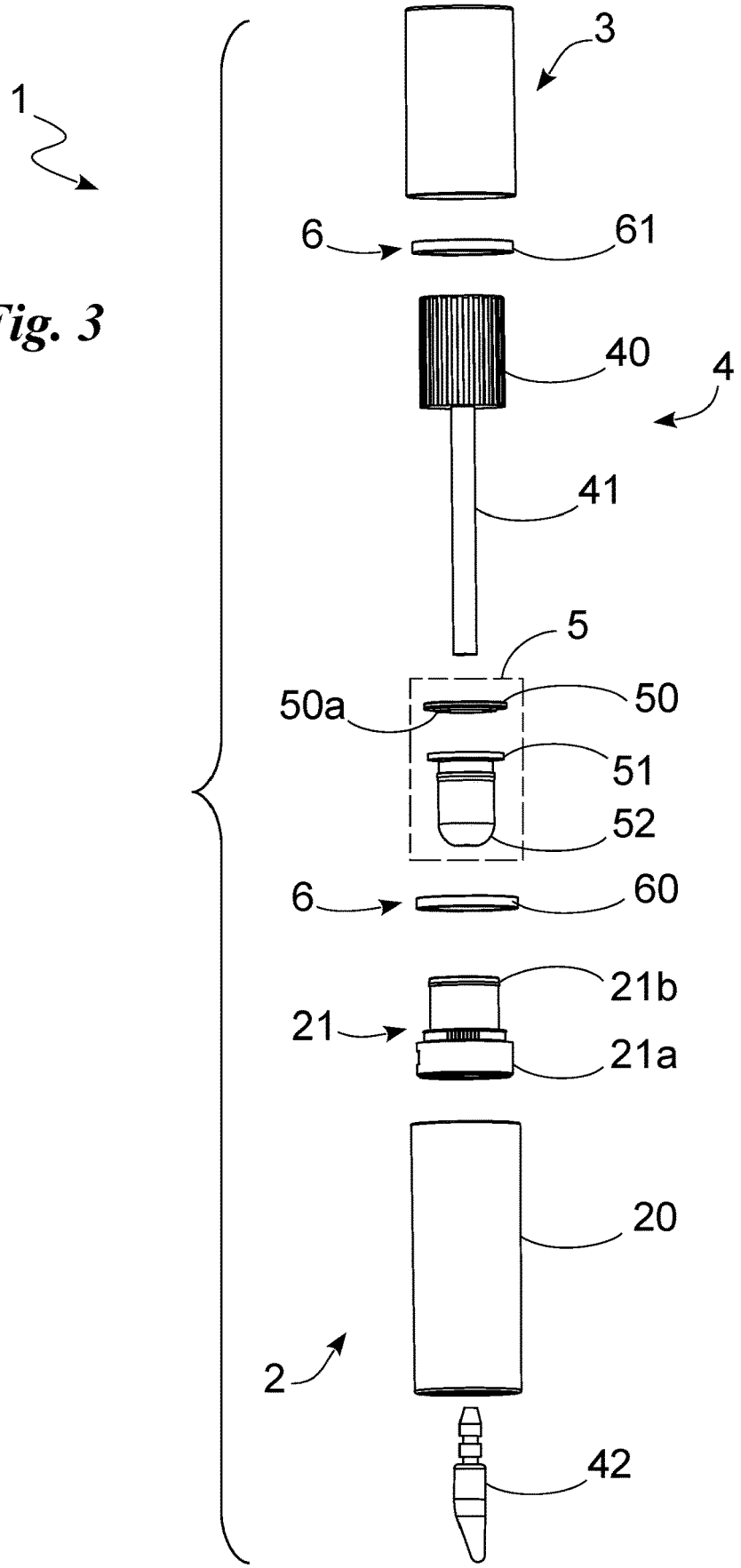
FIG. 3 is an exploded view of the sealed packaging for cosmetics.
Figure 4:
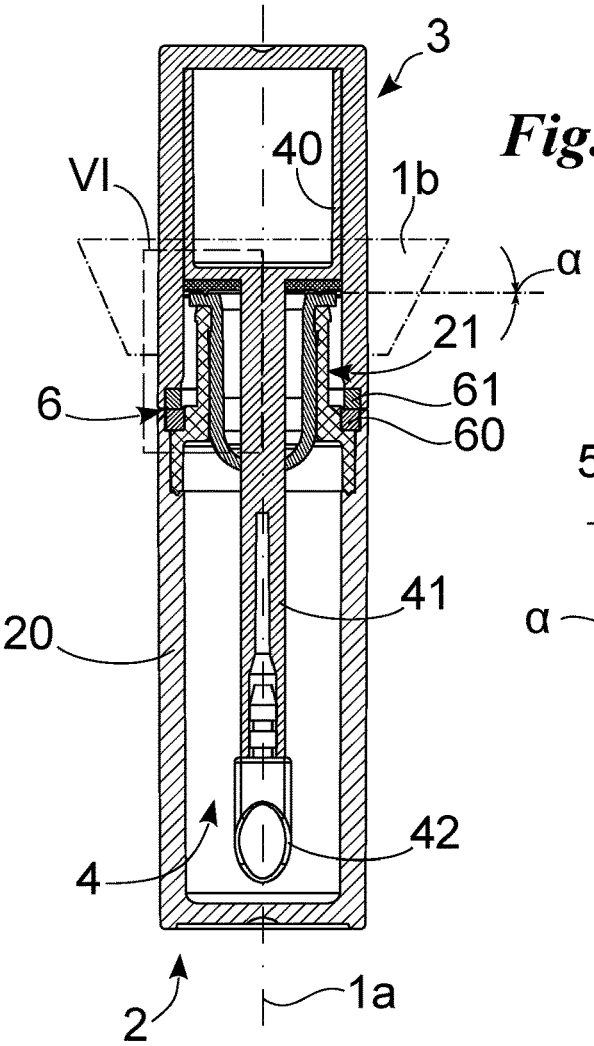
FIG. 4 is a section view of the packaging.
Figure 5B:
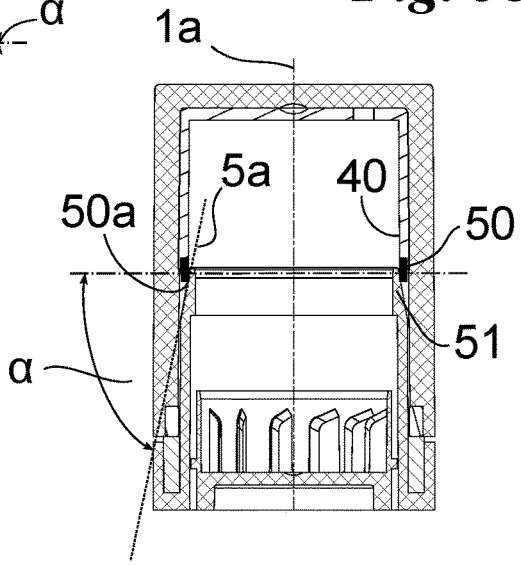
FIG. 5*b* shows a section view of the packaging in a second alternative configuration.
Figure 5A:
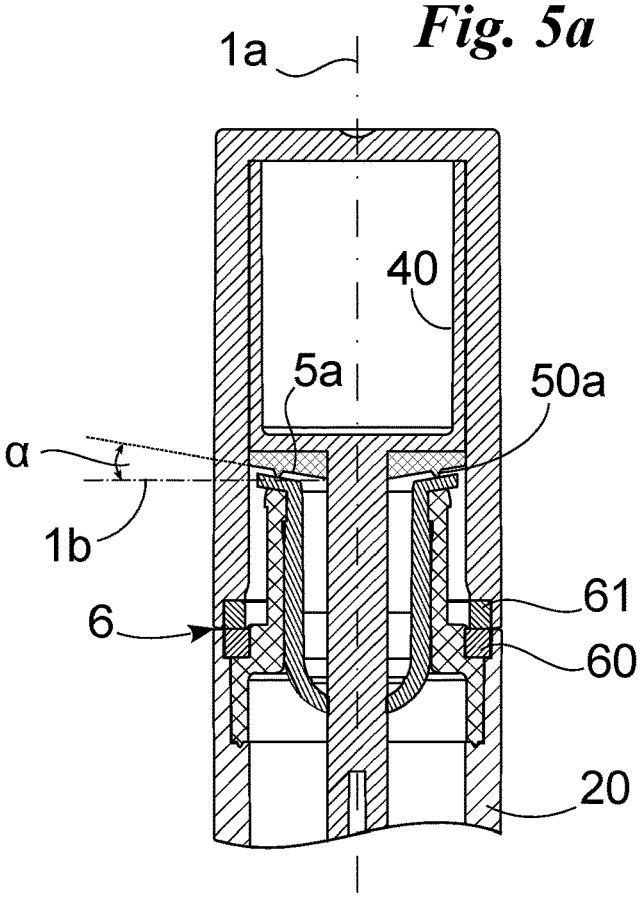
FIG. 5*a* shows a section view of the packaging in a first alternative configuration.
Figure 8:
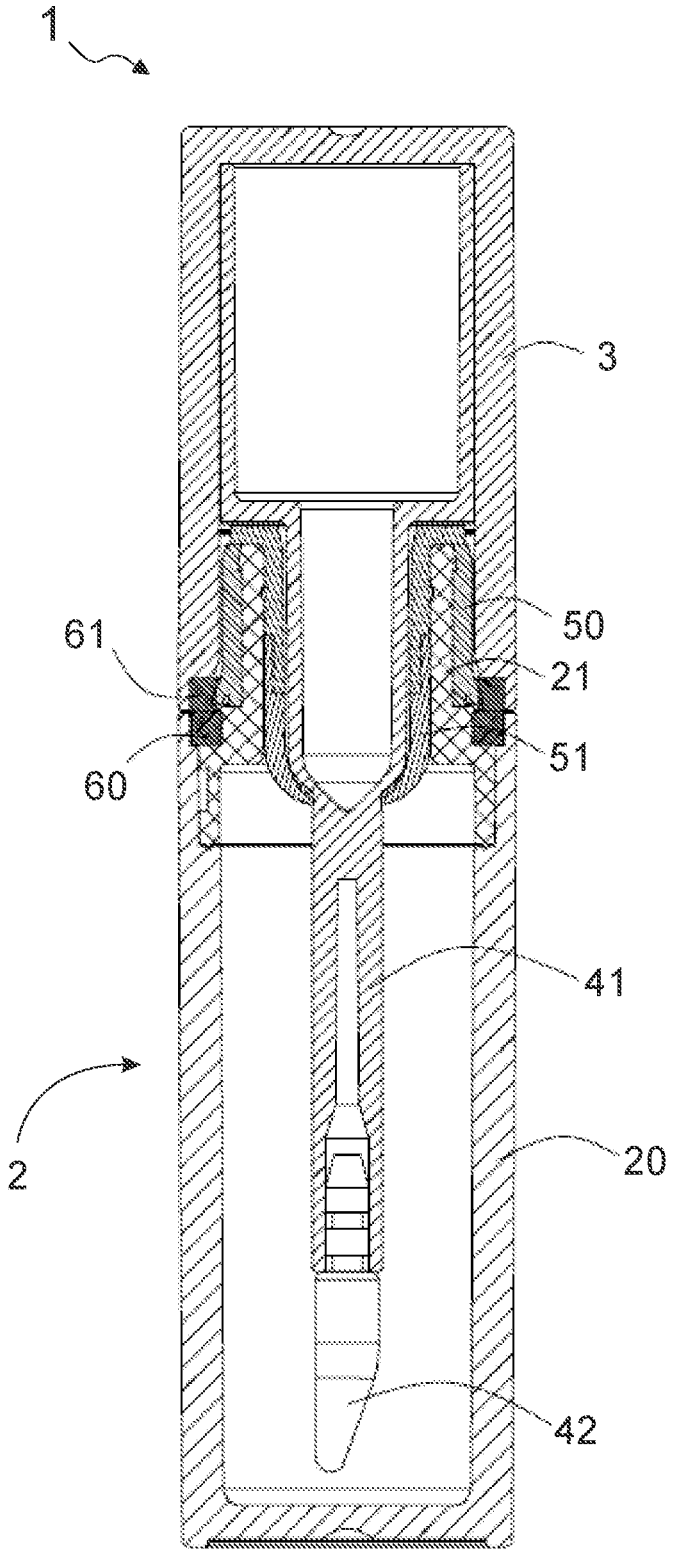
FIG. 8 is a sectional structural diagram of a sealed packaging for cosmetics according to a second embodiment of the invention.
Figure 11:
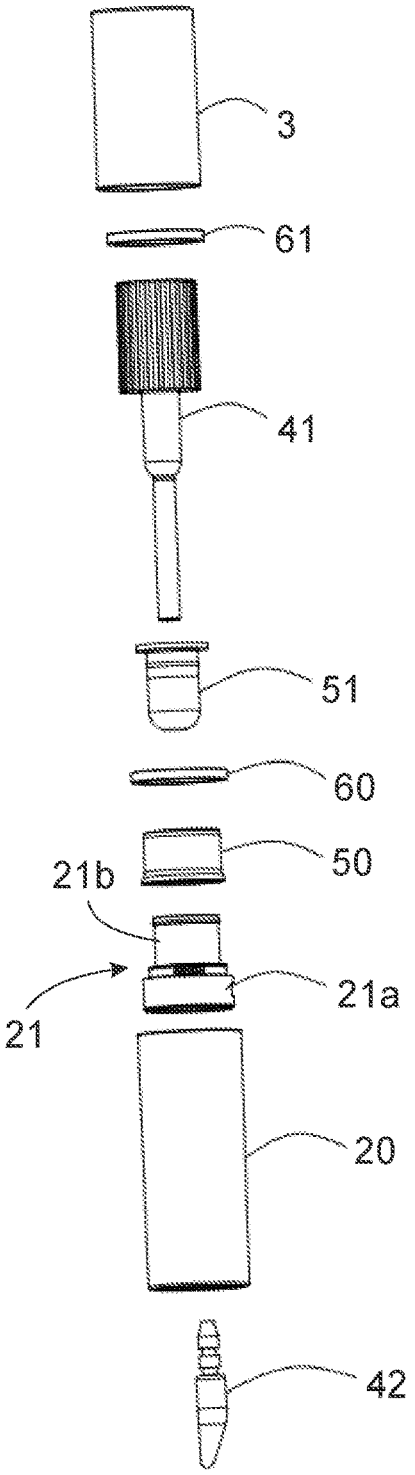
FIG. 11 is an exploded structural diagram of a sealed packaging for cosmetics according to the second embodiment of the invention.

In the present invention, measurements, values, shapes and geometric references (such as perpendicularity and parallelism), when associated with words such as "about" or similar words, such as "almost" or "substantially", are to be understood as short of errors of measurement or inaccuracies due to production and/or manufacturing errors, and above all, short of a minor divergence from the value, measurement, shape or geometric reference to which it is associated. For example, such words, if associated with a value, preferably indicate a divergence not higher than 10% of the value itself.

Moreover, when used, words such as "first", "second", "upper", "lower", "main" and "secondary" do not necessarily identify an order, a relationship priority or a relative position, but may be simply used to distinguish different components more clearly.

With reference to the annexed Figures, the sealed packaging for cosmetics according to the invention is indicated by reference numeral 1 as a whole.

The sealed packaging 1 may be a mascara, a blusher, a lip gloss, a lipstick, an eyeliner, a kajal, an eyeshadow, a gloss, a foundation, a corrector, a serum, a cream, a skincare product, an eye cream or a skincare product.

The sealed packaging 1 for cosmetics defines a longitudinal axis 1*a* and a normal plane 1*b* perpendicular to the longitudinal axis 1*a*. Moreover, it preferably comprises a first containing body 2, a second containing body 3, which is preferably a cap, a central body 4, sealing means 5, and fastening means 6.

With reference to the FIG. 1-7*b* the first containing body 2 preferably consists of two main components. Such components are a reservoir 20 and a connecting element 21.

Reservoir 20 is, for example, a cylindrical vessel centered on the longitudinal axis 1*a*, although it may take different shapes, of variable size, within which a cosmetic product may be arranged.

Therefore, reservoir 20 consists of a closed end and an open end, for example. The latter is adapted to interface with the connecting element 21, for example.

Moreover, reservoir 20 may be made of glass or metal material and it is preferably made of a polymeric material, e.g. with transparent surfaces.

However, the nature of the preferably polymeric material allows different colors, for example.

The connecting element 21 is a cylinder-shaped, centrally pierced cap, for example, centered on the longitudinal axis 1*a*, and comprising a first section 21*a* and a second section 21*b*, the second section 21*b* being preferably smaller than the first section 21*a*.

Preferably, the first section 21*a* is adapted to be housed within reservoir 20 and to be constrained therein.

Alternatively, the first section 21*a* may be adapted to be housed within the second containing body 3 and to be constrained therein.

Therefore, the first section 21*a* and at least part of the inner surface of reservoir 20 comprise connecting means 21*c*.

The connecting means 21*c* are possibly means of variable type provided that they are adapted to constrain the reservoir 20 and the connecting element 21.

The connecting means 21*c* may thus correspond to a helical guide, extending about the longitudinal axis 1*a*, placed at the inner surface of reservoir 20 or second containing body 3, and to a threading placed on the outer surface of the first section 21*a* of the connecting element 21.

Preferably, the connection means 21*c* consist of a reference piece, obtained on the inner surface of reservoir 20 and complementary to the first section 21*a*, comprising at least one protuberance adapted to be inserted into a hole.

The latter hole is thus, for example, complementary to the protuberance mentioned above and is encompassed on the outer surface of the first section 21*a*.

Therefore, the first containing body 2 is, for example, a reservoir 20 surmounted at the free end by a connecting element 21, constrained to the reservoir 20 itself.

The first section 21*a* of the connecting element 21 is preferably incorporated within the casing forming reservoir 20, while the second section 21*b* protrudes, for example, towards the outside of the containing body 2.

Therefore, the first containing body 2 is, for example, a cylinder comprising a step-like section narrowing on the top, but it may also have different shapes, for example square shapes or comprising edges.

Moreover, the first containing body 2 is preferably couplable to the second containing body 3 at the top of reservoir 20, for example.

In all examples, the second containing body 3 is thus preferably a container, e.g. cylindrical in shape and centered on the longitudinal axis 1*a*, comprising a closed end and an open end.

As for the containing bodies 2, 3 may have square shapes or others for example comprising edges.

The open end of the second containing body 3 is thus preferably adapted to cover the area described by the section of reservoir 20 completely.

Therefore, the containing bodies 2, 3 can be reciprocally coupled so as to define a closing configuration defining an inner volume 10.

The inner volume 10 is thus the space delimited by the walls of the containing bodies 2, 3.

With specific reference to the FIG. 1-7*b*, the second containing body 3 preferably comprises the central body 4 therein.

The central body 4 consists, for example, of a cosmetic applicator of variable size and shape.

Therefore, the central body 4 comprises a base 40, a rod 41 and an applicator 42, for example.

Base 40 is preferably adapted to be constrained adhering to the inner surface of the second containing body 3, and in particular at the closed end.

Therefore, it may be constrained to the second containing body 3 by means of adhesive substances or by fitting or by means of mechanical joints provided that the central body 4 remains integrally constrained to the second containing body 3.

For example, rod 41 is a polymeric shank centered on the longitudinal axis 1*a* and constrained to base 40. It extends from the base towards the open end of the second containing body 3 and is adapted to be inserted into the hole defined by the connecting element 21 encompassed in the first containing body 2.

Therefore, the size of rod 41 is preferably such as to ensure the correct closing and adhesion between the second containing body 3 and the first containing body 2. Moreover, the length of rod 41 is preferably such as to allow applicator 42 to be placed near the closed end of reservoir 20 when the first containing body 2 and the second containing body 3 are mutually coupled, i.e. in closing configuration. The rod 41 has preferably a circular perpendicular section or also a not circular section, i.e. oval or half circle or others.

Finally, applicator 42 is a soft means or a bristled element or a spongy element, for example, provided that it is adapted to receive, retain and distribute a cosmetic product upon contact.

In particular, applicator 42 is preferably constrained to the free end of rod 41.

The second containing body 3 comprising the central body 4 is preferably adapted, when coupled to the first containing body 2, to contain the second section 21*b* of the connecting element therein entirely.

In particular, the second section 21*b* is preferably sized so that the outer surface of the second section 21*b* is spaced apart from, and not adherent to, the inner surface of the second containing body 3.

Alternatively the second containing body 3 may be surmounted at the free end by a connecting element 21, constrained to the second containing body 3 itself and the first section 21*a* of the connecting element 21 may be incorporated within the casing forming the second containing body 3, while the second section 21*b* protrudes, for example, towards the outside of the second containing body 3.

Thus the second section 21*b* of the connecting element 21 may be sized so that the outer surface of the second section 21*b* is spaced apart from, and not adherent to, the inner surface of the first containing body 2.

Moreover, the central hole of the connecting element 21 is preferably such as to ensure the insertion of at least part of the central body 4, and in particular of the applicator 42 and rod 41, for example.

The inner walls of the hole of the connecting element 21 are preferably spaced apart from rod 41 when the containing bodies 2, 3 are coupled in closed configuration.

In all examples, the containing bodies 2, 3 are preferably kept coupled by the fastening elements 6.

The fastening elements 6 comprise at least a first fastening element 60 and a second fastening element 61.

The second fastening element 61 is encompassed in the second containing body 3 and preferably at the open end thereof, for example.

The first fastening element 60 is encompassed within the first containing body 2 and preferably at the open end of reservoir 20, for example. However they can also be placed at the top of the rod, near the sealing means 5 or in other places.

The first and second fastening elements 60 and 61 may be mechanical retaining elements or fitting retaining elements, but preferably they are two rings incorporated within the second containing body 3 and the first containing body 2, respectively. It is also possible that there are more rings. The mechanical connection between fastening elements 60 and 61 and respective containing bodies 2, 3 may be made by gluing or by overmolding or co-injection.

In particular, they are of the magnetic type. In detail, at least one the two rings is preferably a permanent magnet and the other ring may be a ferromagnetic element, for example.

The first and second fastening elements 60 and 61 are adapted to define an attraction force therebetween, for example, so as to guide the containing bodies 2, 3 to become coupled when the respective coupling ends, i.e. preferably the free end of the second containing body 3 and the free end of the first containing body 2, are approached.

However, both the first and second fastening elements 60 and 61 may also be permanent magnets appropriately polarized so as to allow the generation of an approaching force therebetween.

Packaging 1 then comprises the sealing means 5.

Such sealing means 5 are adapted to ensure the tight or airtight closing of packaging 1 comprising the cosmetic product.

Therefore, they are preferably elements adapted to prevent the air from passing into the volume described by the reservoir 20 comprising the cosmetic product. Preferably, the sealing means 5 are separate from the fastening means 6 and are spaced apart along the axial direction 1*a*.

In particular, the sealing means preferably consist of a seal 50 and a supporting base 51.

Seal 50 is preferably a deformable element, such as for example an elastomeric seal, but could also be made of a material of different type.

Moreover, seal 50 has substantially a ring-shaped form, for example, centered on the longitudinal axis 1*a*, inserted about rod 41 and constrained to the base 40 of the central body 4.

With specific reference to the FIG. 1-7*b*, the supporting base 51 is instead preferably a ring or an annular structure arranged at the top of the first containing body 2 or the second containing body 3, and more precisely at the top of the opening defined by the connecting element 21, more specifically by the second section 21*b*.

Seal 50 and the supporting base 51 are arranged adjacent and opposite in closing configuration, for example, so as to ensure the airtightness of packaging 1.

In particular, the sealing means 5 define, again in closing configuration, a mutual contact surface 5*a* defining interaction angles $\alpha$ with respect to the normal plane 1*b*. The interaction angles $\alpha$ may be defined by the surfaces in contact with seal 50 and the supporting base 51.

Preferably, the mutual contact surface 5*a* defines interaction angles $\alpha$ smaller than half a right angle, in terms of absolute value.

For example, the seal may be an annular structure or a ring, the outer surface of which forms a mutual contact surface 5*a* with the plane inclined by 30° with respect to the normal plane 1*b*.

More appropriately, the interaction angle $\alpha$ preferably has zero value and therefore the mutual contact surface 5*a* is parallel to the normal plane 1*b*.

For example, in an alternative embodiment (shown in FIG. 5*b*), the mutual contact surface 5*a* defines, with respect to the normal plane 1*b*, an interaction angle $\alpha$ of almost 90°, and preferably between 70° and 90°, thus the seal 50 and the supporting base 51 interact substantially along a direction parallel to the longitudinal axis 1*a*. At least one of the sealing means 5 further comprises a protuberance 50*a*.

The protuberance 50*a* is preferably arranged, in closing configuration, i.e. when the second containing body 3 and the first containing body 2 are coupled, between seal 50 and the supporting base 51.

The aforesaid protuberance 50*a* is further preferably adapted to be deformed by compression when seal 50 and the supporting base 52 are approached in the closing configuration (FIG. 7*a*-7*b*).

At least one protuberance 50*a* is preferably encompassed on the surface of seal 50 and is also substantially ring-shaped and centered on the longitudinal axis 1*a* protruding from the free surface of seal 50 towards the open end of the second containing body 3, if the seal 50 is fitted inside the second containing body 3, or towards the open end of the first containing body 2, if the seal 50 is fitted inside the first containing body 2.

In particular, protuberance 50*a* is a ring or a closed line having a wedge-shaped section on planes passing through the longitudinal axis 1*a*, however it may have different shapes, for example square or semicircular, and therefore may be deformed substantially along a plurality of different directions also dependent on the interaction angles $\alpha$.

However, alternatively or additionally, at least one protuberance 50*a* may be arranged on the surface of the supporting base 51, for example.

Packaging 1 further comprises a collecting element 52.

The collecting element 52 is preferably an elastomeric, perforated basket constrained within the hole of the connecting element 21 at the second section 21*b*. For example, the collecting element 52 rests within the hole of the connecting element 21 and is preferably conical in shape and centered on the longitudinal axis 1*a*, extending towards the inside of reservoir 20 and having, at the smaller end of the aforesaid cone, a hole compatible with the dimensions of rod 41, for example. The collecting element 52 is further preferably adapted to remove the cosmetic product in excess by friction when applicator 42 transits in the collecting element 52. For example, applicator 42 adheres to the collecting element 52 at the hole encompassed at the small end of the collecting element 52.

Preferably, the collecting element 52 is then in one piece with the supporting base 51.

In all three examples, when the second containing body 3 and the first containing body 2 are coupled, the supporting base 51 preferably contacts the protuberance 50*a* of seal 50 or takes protuberance 50*a* into contact with seal 50. Due to said contact, protuberance 50*a* is compressed and deformed, for example, defining a volume portion therein which is sealed with respect to the outside.

Thereby, the cosmetic product encompassed in reservoir 20 is protected from the external environment, for example, and is preserved inside reservoir 20.

Moreover, with reference to FIGS. 1-7*b*, the collecting element 52 is further adapted to clean the applicator 42 of the central body when it is inserted or extracted in/from the first containing body 2. In particular, the (elastomeric) collection portion 51*a* removes by friction, at the edges of the hole, the cosmetic product in excess when the soft brush transits therein.

The operation of the sealed packaging 1 structurally described above is as follows. The user slightly presses the outer surface of the second containing body 3 thus inclining the central body 4 and therefore rod 41 with respect to the longitudinal axis 1*a*. This movement is allowed in particular because the second section 21*b* is spaced apart from the inner surface of the second containing body 3, and therefore the distance between the two elements may be utilized for the wide rotation of the second containing body 3 and the central body 4.

The wide rotation further allows to move applicator 42 inside the reservoir containing the cosmetic product, thus promoting the immersion and impregnation of applicator 42 with the cosmetic.

The latter aspect particularly allows to move the second containing body 3 away from the first containing body 2 without needing to use two hands.

Indeed, the second containing body 3 can be removed from the first containing body 2 by the user with one hand only.

During the removal, applicator 42 passes through the hole of the collecting element 52 and the cosmetic product in excess is cleaned off by the friction between the edges of the supporting base 51 and the surface of applicator 42.

The same occurs when the second containing body 3 is approached to the first containing body 2 and applicator 42 enters into reservoir 20 while transiting through the hole.

It is worth noting, in particular, that once applicator 42 has been inserted into reservoir 20, no force is required to be applied, in particular to return to the closed, i.e. coupling, configuration between the second containing body 3 and the first containing body 2.

Indeed, as the supporting base 51 is preferably in one piece with the collecting element 52, it is sufficient to oscillate or slightly shake packaging 1 to allow rod 41, and thus the central body 4, to align with the longitudinal axis 1*a* again.

Therefore, the second containing body 3 is free to fall by gravity towards the first containing body 2 and is finally pushed by the fastening elements 60 and 61 to be coupled compatibly with the first containing body 2 itself.

With reference to the FIGS. 8-11, the sealed packaging for cosmetics, according to a second embodiment, comprises preferably sealing means 5 sleeved at an outer side of at least one of the containing bodies 2, 3, and an outer wall of the seal 50 is provided with the protuberance 50*a* suitable to create an air gap 50*b* and to be deformed so to at least partially compress the air gap 50*b* when the sealed packaging 1 is closed.

The sealing means 5 of FIGS. 8-11 preferably comprises the seal 50, which is ring shaped. The seal 50 includes, on an outer wall, the protuberance 50*a*, which is preferably a flexible ring for example provided at a bottom of the seal 50. When the second containing body 3 is matched with the first containing body 2, an inner wall of the seal 50 fits with the first containing body 2 and the outer wall of the seal 50 and an inner wall of the second containing body 3 fit with each other.

An end surface of the protuberance 50*a* is separated from a lower end surface of the seal 50 forming the gap 50*b* or a space. The protuberance 50*a* preferably protrudes outside. The protuberance 50*a* and the seal 50 are preferably an integrated injection molding structure.

An inner side of the second containing body 3 is preferably provided with a first inclined edge 31. The first inclined edge 31 is positioned for example over the first or second fastening element 60, 61, preferably on the second fastening element 61, and is suitable to face the protuberance 50*a*. After the second containing body 3 and the first containing body 2 are matched, the first inclined edge 31, the protuberance 50*a*, the seal 50, the second containing body 3 and, for example, the second fastening element 61 form a sealed space.

When the sealed packaging for cosmetics 1 is in use, the second containing body 3 drives the central body 4 to be removed from the first containing body 2 and, after dipping a cosmetic paint in the first containing body 2, the central body 4 may be used.

After the end of the use, the central body 4 is placed into the first containing body 2. The containing bodies 2, 3 are fastened with each other. The second containing body 3 moves from a top end to the bottom of the seal 50.

The first fastening element 60 and the second fastening element 61 attract with each other.

In this case, as in all examples described, the second containing body 3 and the first containing body 2 are then fastened with each other. Meanwhile, when the second containing body 3 moves downwards, it gradually contacts the protuberance 50*a*. The space, or gap 50*b*, formed by the first inclined edge 31, the protuberance 50*a*, the seal 50, the second containing body 3 and the second fastening element 61 is gradually reduced, thus the pressure in the space increases gradually and air may not enter into the space from outside, thereby having sound sealed effect between the second containing body 3 and the first containing body 2.

Furthermore, under the extrusion effect on the protuberance 50*a* by the air pressure in the space formed by the first inclined edge 31, the protuberance 50*a*, the seal 50, the second containing body 3 and the second fastening element 61 and the lateral extrusion on the protuberance 50*a* by the second containing body 3, the protuberance 50*a* presses down the seal 50, thereby making the air among the protuberance 50*a*, the seal 50 and the first containing body 2 be extruded out gradually.

Furthermore, the protuberance 50*a* pressing down the seal 50 makes the space form a negative pressure, makes the protuberance 50*a* and the first containing body 2 fit tightly, and creates sound sealed effect. All these effects of the seal 50 and the protuberance 50*a* are common to all the embodiments described.

To facilitate the matching between the second containing body 3 and the protuberance 50*a*, the matching place between the second containing body 3 and the protuberance 50*a* is preferably provided with circular arc transition, thereby making the protuberance 50*a* and the second containing body 3 match tightly, ensure the seal 50 and the second containing body 3 fit tightly, and ensuring the seal.

Figure 12:
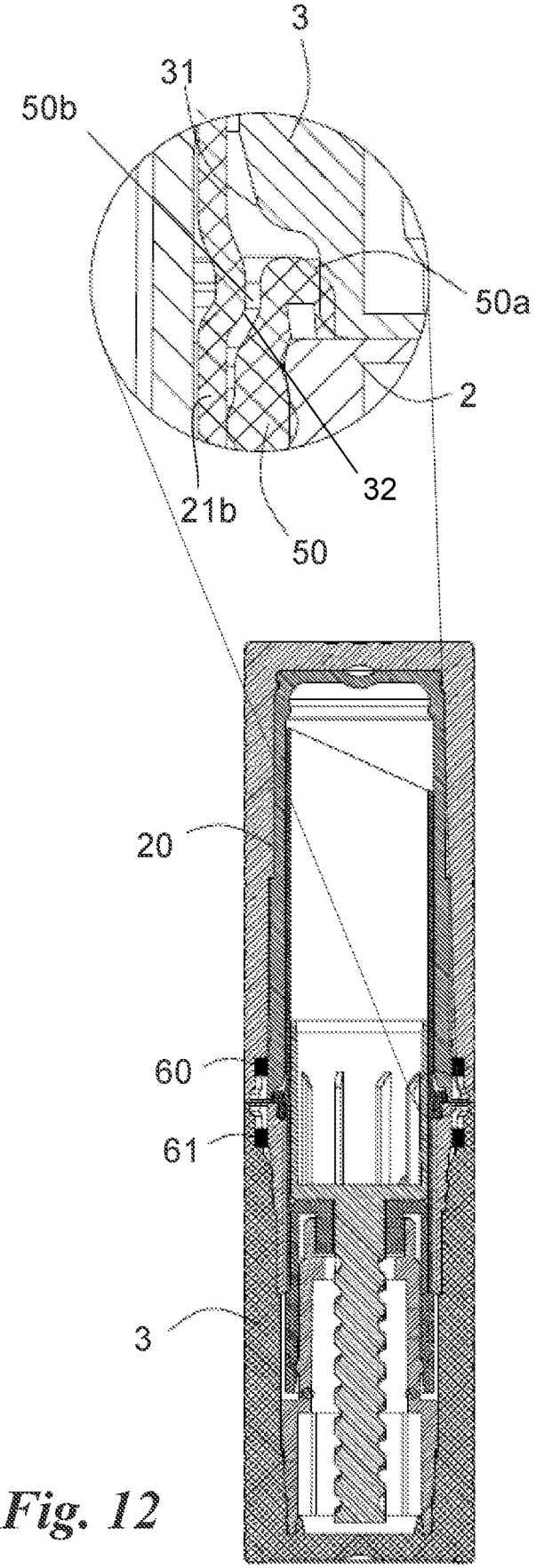
FIG. 12 is a sectional structural diagram of the sealed packaging for cosmetics according to a third embodiment of the invention.

With reference to the FIG. 12-13, the sealed packaging for cosmetics 1, according to a third embodiment, comprises sealing means 5 preferably including the seal 50. Furthermore, the seal 50 preferably comprises the protuberance 50*a* or flexible ring, illustrated in FIGS. 12-13. Moreover, an inner side of the first containing body 2 is provided with a second inclined edge 32 for example counter-shaped to the protuberance 50*a*.

When the second containing body 3 is matched with the first containing body 2, an inner wall of the seal 50 fits with the second containing body 3, and an outer wall of the seal 50 fits with the inner wall of the first containing body 2.

The packaging 1 of the third embodiment also includes the connecting element 21 sleeved at the bottle opening of the second containing body 3. One end of the connecting element 21 preferably fits with the inner wall of the first containing body 2. The seal 50 is sleeved at the outer side of the bottle opening of the second containing body 3 through the connecting element 21.

The seal 50 is preferably sleeved at the outer side of the bottle opening of the second containing body 3 and precisely on the second section 21*b* of the connecting element 21.

When the packaging 1 is in use, the second containing body 3 and the first containing body 2 are fastened with each other. With the attraction force between the first fastening element 60 and the second fastening element 61, the second containing body 3 and the first containing body 2 attract tightly.

During the covering process of the containing bodies 2, 3, the first containing body 2 moves from a bottom to a top end of the seal 50. Meanwhile, the first containing body 2 moves downwards and contacts with the flexible ring 50*a* gradually.

The, gap 50*b*, or space formed among the seal 50, the protuberance 50*a* and the first containing body 2 is reduced gradually, thus the pressure in the space increases gradually, and the external air may not enter, thereby having the sound sealed effect between the second containing body 3 and the first containing body 2. Furthermore, under the extrusion effect on the protuberance 50*a* by the air pressure in the space formed by the seal 50, the protuberance 50*a* and the first containing body 2 and the lateral extrusion on the protuberance 50*a* by the first containing body 2, the protuberance 50*a* presses down the seal 50.

The protuberance 50*a* pressing down the seal 50 thereby makes the air in a first cavity form among the protuberance 50*a*, the seal 50 and the second containing body 3 be extruded out gradually, makes the first cavity form a negative pressure, makes the seal 50 and the second containing body 3 fit tightly, and improves the sealed effect.

Exactly the same functionality of embodiment of FIGS. 12-13 is provided by the embodiment of FIGS. 14-15 wherein the protuberance 50*a* is in one piece and continuous with the seal 50. In this specific case the air flows-out, after the closure of the packaging 1, from a gap 50*b* formed between the same seal 50 and the substantially rigid external part of the wall of the containing bodies 2, 3. Said seal is illustrated in scale in FIGS. 15*a* and 25*b*.

The sealed packaging 1 for cosmetics according to the invention achieves important advantages.

Indeed, a first advantage is that packaging 1 can ensure a tight closing of reservoir 20 and thus prevent the cosmetic product from deteriorating and becoming unusable.

Such an advantage is obtained in an innovative manner by virtue of the elastic deformation of the protuberance 50*a* encompassed on seal 50 which, being compressed on the supporting base 51 or the second containing body 3 surface, allows to close the volume contained therein tightly or air-tightly.

Therefore, another advantage is the increased capacity of preserving the cosmetic product and thus the possibility of using the entire cosmetic product.

Such an aspect is accentuated in that the compression of the protuberance 50*a* allows to absorb minor changes in shape/size which reduce the overall wear of the container without compromising the tight closure.

Such an increased duration of the cosmetic product allows to have a packaging provided with a greater capacity and thus more cost-effective products.

A further advantage is the simplicity and speed at which the device allows to extract the central body 4, i.e. the applicator, from the first containing body 2.

Additionally, the sealed packaging 1 also includes the advantage of being able to be opened, i.e. to move the second containing body 3 away from the first containing body 2, by applying forces of lesser entity which correspond to a slight side pressure on the outer surface of the second containing body 3.

Moreover, this allows to utilize the functions of the sealed packaging 1 entirely by means of simplified movements which may involve only one hand of a user, for example, thus without the need to use the grip of the second containing body 3 to move it away from the containing body 2.

In particular the synergistic interaction between the sealing means 5 and the fastening means 6 allows a user to open and close the packaging 1 without the need to apply a torque action as, for example, for conventional casings.

In conclusion, a further advantage of the packaging 1 consists in that, in particular in the main embodiment, the reduction of obstructions between the second containing body 3 and the first container body 2 allows not only, as already said, to extract the rod 41 with greater agility and lighter pressures, but it also allows the reduction of flexural strength during the inclination of the second containing body 3 in the phase of opening of the packaging 1 as well as a reduction of the resisting global force to the opening.

Thanks to said reduction in resistance, the risk of spillage of cosmetic product due to clumsy casing openings is limited, if not completely removed, while it is still guaranteed the proper tightness in the closed configuration.

The invention is susceptible of variants falling within the scope of the inventive concept described in the independent claims and in the respective technical equivalents.

For example, applicator 42 may be chosen from: a brush if packaging 1 is identifiable in a mascara; a sponge if packaging 1 is identifiable in a lip gloss, a gloss, a corrector or a lipstick; a soft brush if packaging 1 is identifiable in an eyeliner, a foundation or a kajal; a brush or other similar element adapted to allow to take and apply the product, and in particular the cosmetic liquid.

Furthermore, all the embodiments of the sealed packaging for cosmetics 1 previously described may be implemented one by one on the packaging 1 or may be implemented together. For example, the packaging 1 may comprise both types of sealing means of embodiments of FIGS. 1-7*b* and 8-11 together, or sealing means 5 of FIGS. 1-7*b* can be coupled with sealing means 5 of FIGS. 12-15. All the solutions described may be mixed together entirely or partially without departing from the inventive concept of the invention.

In such a scope, all the details can be replaced by equivalent elements and the materials, shapes and dimensions may be varied.

The invention claimed is:

1. A sealed packaging for cosmetics defining a longitudinal axis and a normal plane perpendicular to a longitudinal axis, comprising:

a first containing body, a second containing body, a central body comprising an applicator, wherein said first containing body is couplable to said second containing body, defining a closing configuration, defining an inner volume of said packaging, and an opening configuration for said packaging, wherein said central body is constrained and partially arranged inside said second containing body and is also partially arranged inside said first containing body when said packaging is in the closing configuration, wherein said containing bodies comprise fastening means of magnetic type adapted to couple said second containing body and said first containing body, and wherein the packaging further comprises sealing means separated and spaced apart along said axial direction from said fastening means and comprising a gasket and a supporting base arranged adjacent and opposite to each other in said closing configuration so as to ensure the airtightness of said packaging, said sealing means being separate from said fastening means and being spaced apart along said axial direction, wherein said gasket comprises a protuberance, and wherein said supporting base deforms said protuberance in closing configuration by compression.

2. The packaging according to claim 1, wherein said sealing means define a mutual contact surface in said closing configuration, defining interaction angles smaller than half a right angle with respect to said normal plane.

3. The packaging according to claim 2, wherein said mutual contact surface is parallel to said normal plane.

4. The packaging according to claim 1, wherein said protuberance is a ring having a wedge-shaped section on planes passing through said longitudinal axis.

5. The packaging according to claim 1, comprising a collecting element adapted to remove the cosmetic product in excess by friction when said applicator transits within said collecting element, said collecting element being in one piece with said supporting base.

6. The packaging according to claim 1, wherein said fastening means comprise a first fastening component and a second fastening component, said first fastening component being included within said second containing body and said second fastening component being included within said first containing body.

7. The packaging according to claim 1, said sealing means being spaced apart along said axial direction of a distance greater than 5 mm.

8. The packaging according to claim 1, wherein said central body comprises a base and a rod, said base being constrained to said second containing body, said rod being constrained to said base and adapted to be inserted into the first containing body, and said applicator being a soft brush and being arranged at the free end of said rod.

9. The packaging according to claim 1, wherein said first containing body comprises a reservoir and a connecting element, said reservoir being adapted to contain said cosmetic product and said connecting element being adapted to be constrained at the free end of said reservoir and being arranged within said inner volume.

10. A sealed packaging for cosmetics defining a longitudinal axis and a normal plane perpendicular to a longitudinal axis, comprising:

a first containing body, a second containing body, a central body comprising an applicator, wherein said first containing body is couplable to said second containing body, defining a closing configuration, defining an inner volume of said packaging, and an opening configuration for said packaging, wherein said central body is constrained and partially arranged inside said second containing body and is also partially arranged inside said first containing body when said packaging is in the closing configuration, wherein said containing bodies comprise fastening means of magnetic type adapted to couple said second containing body and said first containing body, and wherein the packaging further comprises sealing means separated and spaced apart along said axial direction from said fastening means and comprising a gasket and a supporting base arranged adjacent and opposite to each other in said closing configuration so as to ensure the airtightness of said packaging, said sealing means being separate from said fastening means and being spaced apart along said axial direction comprising a collecting element adapted to remove the cosmetic product in excess by friction when said applicator transits within said collecting element, said collecting element being in one piece with said supporting base.

11. The packaging according to claim 10, wherein said sealing means define a mutual contact surface in said closing configuration, defining interaction angles smaller than half a right angle with respect to said normal plane.

12. The packaging according to claim 11, wherein said mutual contact surface is parallel to said normal plane.

13. The packaging according to claim 10, wherein said fastening means comprise a first fastening component and a second fastening component, said first fastening component being included within said second containing body and said second fastening component being included within said first containing body.

14. The packaging according to claim 10, said sealing means being spaced apart along said axial direction of a distance greater than 5 mm.

15. The packaging according to claim 10, wherein said central body comprises a base and a rod, said base being constrained to said second containing body, said rod being constrained to said base and adapted to be inserted into the first containing body, and said applicator being a soft brush and being arranged at the free end of said rod.

16. The packaging according to claim 10, wherein said first containing body comprises a reservoir and a connecting element, said reservoir being adapted to contain said cosmetic product and said connecting element being adapted to be constrained at the free end of said reservoir and being arranged within said inner volume.

* * * * *